United States Patent [19]

Michel et al.

[11] Patent Number: 4,652,430

[45] Date of Patent: Mar. 24, 1987

[54] APPARATUS FOR MULTI-STAGE REFINING OF ORGANIC BULK MATERIALS

[75] Inventors: Wolfgang Michel, Magdeburg; Heinz Paul, Möser; Dieter Köstler; Frank Wilhelm, both of Magdeburg; Andreas Rummel, Dessau; Gero Seher, Wernigerode; Wilfried Henze, Magdeburg; Ralf Hander, Berlin; Jürgen Heinemann; Manfred Ossowski, both of Magdeburg, all of German Democratic Rep.

[73] Assignee: VEB Schwermaschinenbau "Karl Liebknecht" Magdeburg, Magdeburg, German Democratic Rep.

[21] Appl. No.: 654,832

[22] Filed: Sep. 26, 1984

[30] Foreign Application Priority Data

Jan. 20, 1984 [DD] German Democratic Rep. ..... 2596983

[51] Int. Cl.[4] ..... F27B 15/08; C10B 47/24; C10B 49/10; C10J 3/56

[52] U.S. Cl. ..... 422/142; 48/62 R; 201/31; 202/99; 202/108; 202/116; 422/145; 422/195

[58] Field of Search ..... 202/99, 103, 104, 108, 202/109, 116, 117, 121; 48/62 R, 76, 77; 201/31–34, 44; 422/142, 145, 193, 195; 34/57 R, 57 A; 432/58

[56] References Cited

U.S. PATENT DOCUMENTS

| | | | |
|---|---|---|---|
| 1,955,025 | 4/1934 | Sabel et al. | 202/99 |
| 2,619,451 | 11/1952 | Ogorzaly et al. | 202/121 |
| 2,626,234 | 1/1953 | Barr et al. | 201/31 |
| 2,890,106 | 6/1959 | Heath | 422/142 |
| 3,079,222 | 2/1963 | Reeve | 422/142 |
| 3,375,175 | 3/1968 | Eddinger et al. | 201/31 |
| 3,573,224 | 3/1971 | Strelzoff et al. | 422/142 |
| 4,147,523 | 4/1979 | Izumo | 55/269 |
| 4,404,086 | 9/1983 | Oltrogge | 201/31 |
| 4,457,896 | 7/1984 | Kono | 422/142 |

FOREIGN PATENT DOCUMENTS

| | | |
|---|---|---|
| 2939976 | 4/1980 | Fed. Rep. of Germany . |
| 2947222 | 5/1981 | Fed. Rep. of Germany . |

*Primary Examiner*—Barry S. Richman
*Assistant Examiner*—Joye L. Woodard
*Attorney, Agent, or Firm*—Jordan and Hamburg

[57] ABSTRACT

An apparatus for the multi-stage refining of organic bulk materials according to the fluidized bed principle comprising a plurality of horizontally aligned cells (23) including an upper drying chamber (1), a middle degasification chamber (2) and a lower refining chamber (3) separated from each other by an individual gas permeable floor (19) or a gas impermeable floor (20). Adjacent cells are connected to each other by common discharge/charge chutes having vertical separation walls extending therein.

1 Claim, 3 Drawing Figures

APPARATUS FOR MULTI-STAGE REFINING OF ORGANIC BULK MATERIALS

BACKGROUND OF THE INVENTION AND PRIOR ART STATEMENT

The invention relates to a multi-stage refining method for organic bulk materials, according to the fluidized bed principle, for the production of low temperature carbonization gas, liquid products, and if necessary, coke, and an apparatus for performing this method.

A method for the gasification of carbonaceous materials is already known from the DE-OS 2947222, whereby a fluidized bed and fine dust gasification, and if necessary, also a solid bed gasification, take place continuously in a reaction chamber comprising one or several stages. In the direction of the gas stream, a given existing solid bed gasification is followed by two superposed and continuous stages of a fluidized bed gasification, whereby the charge of the crude raw material takes place in the lower stage thereof. Furthermore, in the lower fluidized bed, there are also immersed one or several fine dust gasification chambers having gasification burners mounted on the outside of the reaction chamber.

The method serves exclusively for the recovery of gas, whereby the solid materials are practically completely utilized; the only remaining residue is ash or slag. The configuration of all of the gasification stages in one reaction chamber, however, allows only an insufficient variability of the execution of the method with respect to the production of additional products, as well as to the temperature ratios in the individual stages.

The recovery of liquid products from a gas having compositions which are variable only within narrow limits, therefore is possible only at a high cost. The method further requires high energy consumption, and is unsuitable for the large-scale processing of carbonaceous materials. This deficiency, furthermore, results from the construction of the reactor, which requires high material and technical production expenses.

A method for the production of oil, gas and coke from coal according to the fluidized bed principle is known from the DE-OS No. 2939976. This is a multistage method comprising a grinding, a drying, a previous heating, two pyrolysis stages, as well as a stage for the partial gasification and heat development. The overhead streams of individual stages are thereby guided to the fluidization and heating located at upstream stages. The heat for the method is recovered from the partial carbonization of the coal particles in the last stage.

This method allows the regulation of the quantity portions of the end product, however, it does not reveal any possibility for its practical realization, particularly for the large-scale utilization of coal.

A method and an apparatus for the rapid pyrolysis of lignite has already been proposed (WP C No. 10 B/2490798) consisting of a two-stage method according to the fluidized bed principle for the production of coke, gas and tar. The fluidization of the coal is performed in a dryer via an influx floor. The fluidizing medium is produced in a carbonization chamber which is charged in the recycling direction with a part of the vapors from the drying. The dried coal is discharged via a discharge dike and is charged via a conveying apparatus and an intermediary bunker into the pyrolysis reactor. A carbonaceous gas alien to low temperature carbonization is utilized as a fluidizing medium which is heated in a preheater. The fluidized bed, also built up on an influx floor, is furthermore indirectly heated by a heat exchanger, through which is flowing the offgas of an additional carbonization chamber. Subsequently, the offgas heats the preheater, and is utilized as a mixing component for the direct heating in the dryer. The discharge dike provided in both stages simultaneously serves for the regulation of the height of the fluidized bed, and thereby for the determination of the residence time allocated to the coal in each particular stage.

This method still needs improvements with respect to the solid material transport, the determination of the residence time allocated in the stages, and the degree of the energy efficiency. The method, combined with the corresponding equipment, causes energy losses during the solid material transport, and provides an insufficient variability with respect to the quantity portions and the quality of the end product.

The equipment, furthermore, comprises a relatively large amount of apparatus, so that a large-scale utilization of the method requires a high capital investment.

SUMMARY OF THE INVENTION

The object of the invention is to provide a method and an apparatus for the multi-stage refining of organic bulk materials leading to a large-scale material and energy utilization thereof. It guarantees the conversion of bulk materials of various quality, a high degree of energy efficiency of the method and the apparatus, and which can be realized with an economically advantageous investment, by providing a high variability with respect to quantity proportions and quality of the end product.

Another object of the invention is to provide a method and an apparatus for the multi-stage refining of organic bulk materials, so that, by assigning the refining stages in connection with carrying out the transport of the solid material, there results a high variability in the quantitative and qualitative working process; that energy recovered in the refining stages, as well as, if necessary, energy supplied from the outside, is exploited at the least possible loss, and that the equipment has a compact construction for a large-scale plant of low space requirements and high throughput capacity.

These and other objects and advantages of the present invention will become apparent from the description which follows.

According to the invention, the object is solved, whereby the solid material transport of each refining stage takes place individually from the charge side to the opposite side and that the solid material transport is performed by gravity from one refining stage to the subsequent one, via a combined discharge/charge chute; that if the production of coke is omitted, subsequently to the degasification process, there follows an immediately continuous additional refining stage, which can be configured either as a carbonization stage or as a gasification stage; and that the necessary energy requirement of all the refining stages is selectively recovered either from the individual refining stages, or is supplied from the outside, or by a combination of these two possibilities, whereby the heat transmission occurs either directly or indirectly.

For the execution of the method with a continuous gasification stage, which is heated indirectly by the offgas of a carbonization chamber, the carbonization chamber simultaneously serves for preheating a mixture of a part of the gasification gas and/or water vapor, which is supplied directly to the gasification stage. By means of the offgas of the carbonization chamber, if necessary, after a subsequent heating in a second carbonization chamber, there also takes place an indirect heating of one or more degasification stages, through which the gasification gas passes directly.

A subsequent carbonization step following the degasification stage is charged with air, the gasification gas flows directly through the degasification steps, which furthermore are indirectly heated by the offgas of a carbonization chamber.

A further execution of the method consists in that the offgas of the carbonization chamber is supplied as a fluidizing medium to the drying stages which, furthermore, are alternatively heated indirectly by a part of the gasification or carbonization gas and/or are charged with a part of the vapors from the drying.

The dust removed from the drying stages is transferred to a separate low temperature dust carbonization.

The apparatus according to the invention consists in that the refining stages are configured one below another in a reactor having a rectangular cross section, separated from each other by the individual influx floor or a floor impermeable to gas, and connected to each other by individual, combined discharge/charge chutes which are located on opposite sides, and that the existing individual cells, each comprising a reactor, carbonization chambers and preheaters are aligned in a battery. One of the configurations of the apparatus consists in that each two adjacent cells are provided with a common separation wall, and that the corresponding combined discharge/charge chutes of these cells are positioned on both sides of this separation wall which is discontinuous in this area.

Other configurations consist in that the assigned preheater of a refining stage is an integrated component of the corresponding carbonization chamber; that the cells of a battery are connected in parallel with respect to bulk material charge and product discharge; and that to a corresponding number of cells of a battery, there is assigned an additional cell for the low temperature dust carbonization.

BRIEF DESCRIPTION OF THE DRAWINGS

The invention is explained in detail by the following exemplified embodiment. The corresponding drawings show in schematic representation.

DETAILED DESCRIPTION OF THE PREFERRED EMBODIMENTS

Figure 1:
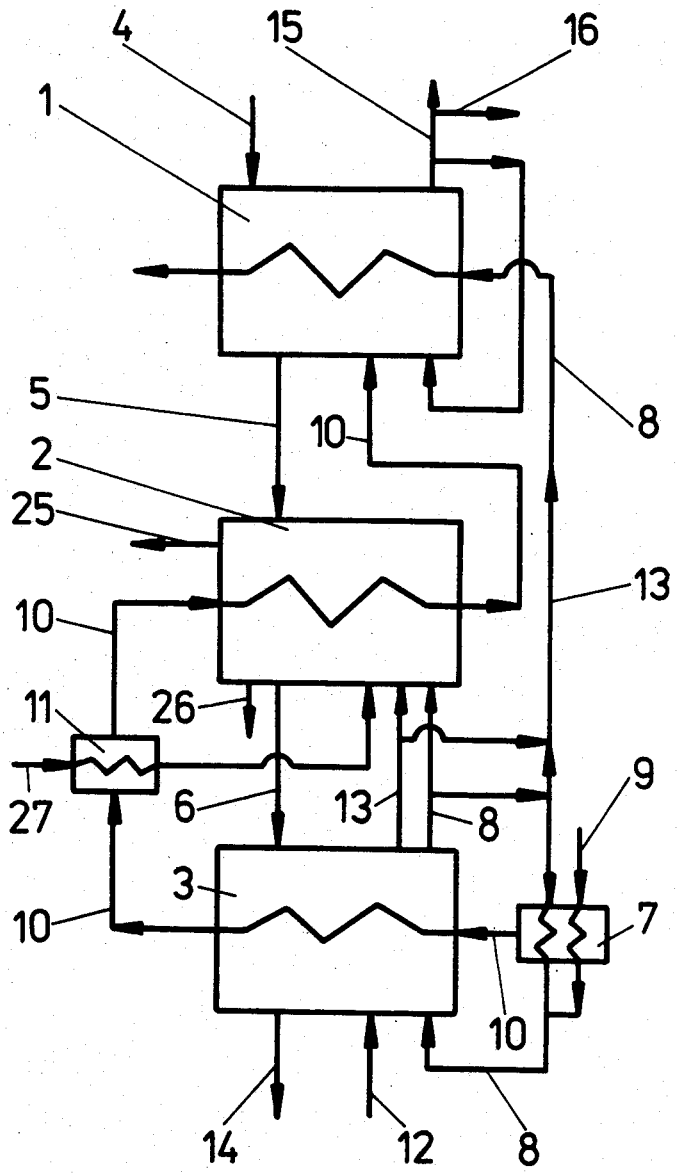
FIG. 1: a flow diagram of the method.

The present invention is directed to a method for the multi-stage refining of orgianic bulk materials according to the fluidized bed principle, for the production of low temperature carbonization gas, liquid products and, if necessary, coke and an apparatus for the execution of the method. The method makes possible the large-scale material and energy utilization of bulk materials, with the object of achieving a high variability in quantitative and qualitative executions of the method, a compact construction of the apparatus and a high throughput performance at low space requirements. The method is characterized by the refining stages, where there occurs an exactly defined solid material transport, allowing the number and the kind of refining stages to be selected within a large range, and providing that the energy requirement of the refining stages are very variable. The appartaus consists of refining stages which are configured one below another in a reactor having a rectangular cross section, separated from each other by the individual influx floor or a floor which is impermeable to gas, and connected to each other by individual combined discharge/charge chutes located on opposite sides, and the individual existing cells, which are aligned in a battery, include a reactor, carbonization chamber and preheater.

Following is a glossary of terms and phrases (and reference numerals), and apparatus elements and members, as employed in the present invention.

GLOSSARY

1. Drying chamber
2. Degasification chamber
3. Refining chamber
4. Bulk goods
5. Discharge/charge chute
6. Discharge/charge chute
7. Carbonization chamber
8. Gasification chamber
9. Water
10. Offgas
11. Carbonization chamber
12. Air
13. Carbonization
14. Ash
15. Vapors
16. Dust
17. Discharge dike
18. Bulk goods charge
19. Influx floor
20. Floor
21. Ash discharge
22. Sealing part
23. Reactor
24. Separation wall
25. Gas product discharge
26. Coke product discharge
27. Natural gas Referring to the drawings, the flow diagram according to FIG. 1 shows in simplified form only a drying stage 1 and a degasification stage 2, at the outlet side of which is connected the refining stage 3. The bulk goods 4 are charged into the drying stage 1. After the drying, the transfer through the combined discharge/charge chute 5 to the degasification stage 2 positioned underneath it occurs, in which the low temperature coke carbonization of the bulk goods is performed. The coke is transported via an additional discharge/charge chute 6 in the subsequent refining stage 3. The charging of the refining stages with the fluidizing medium takes place in counterflow thereof. A continuous carbonization stage 3*a* or a gasification stage 3*b* increases the production of low temperature carbonization gas and/or liquid products. For the gasification of the coke, the fluidized bed in this refining stage 3 is indirectly heated by the offgas 10 of a carbonization chamber 7, which simultaneously serves for the preheating of a mixture consisting of a part of the gasification gas 8 and water vapor 9, which is supplied to the fluidized bed as a fluidizing medium. The offgas 10, if necessary, is heated again in a second carbonization chamber 11, and is supplied for the indirect heating of the fluidized bed through the degasification stage 2. The gasification gas 8 thereby represents the fluidizing medium for the degasification stage 2.

In the carbonization of the coke in the refining stage 3, this stage is charged with air 12, and the carbonization gas 13, which is utilized as a fluidizing medium, flows through the degasification stage 2, which is indirectly heated by the offgas 10 of the carbonization chamber 11. Ash is discharged from the carbonization or gasification stage 3.

If there is no continuous refining stage 3 after the degasification stage 2, then the carbonization chamber 11 performs the indirect heating of the fluidized bed in the degasification stage 2, by means of offgas 10, whereby the carbonization chamber 11 simultaneously also serves for preheating a fluidizing medium, such as, for instance, natural gas 27, which is directly supplied to the degasification stage 2. In this case, the coke product discharge 26 is located at the degasification stage 2. The low temperature carbonization gas is discharged in each variation of the method through the gas product discharge 25 of the degasification stage 2 and is transferred for condensation.

Figure 2:
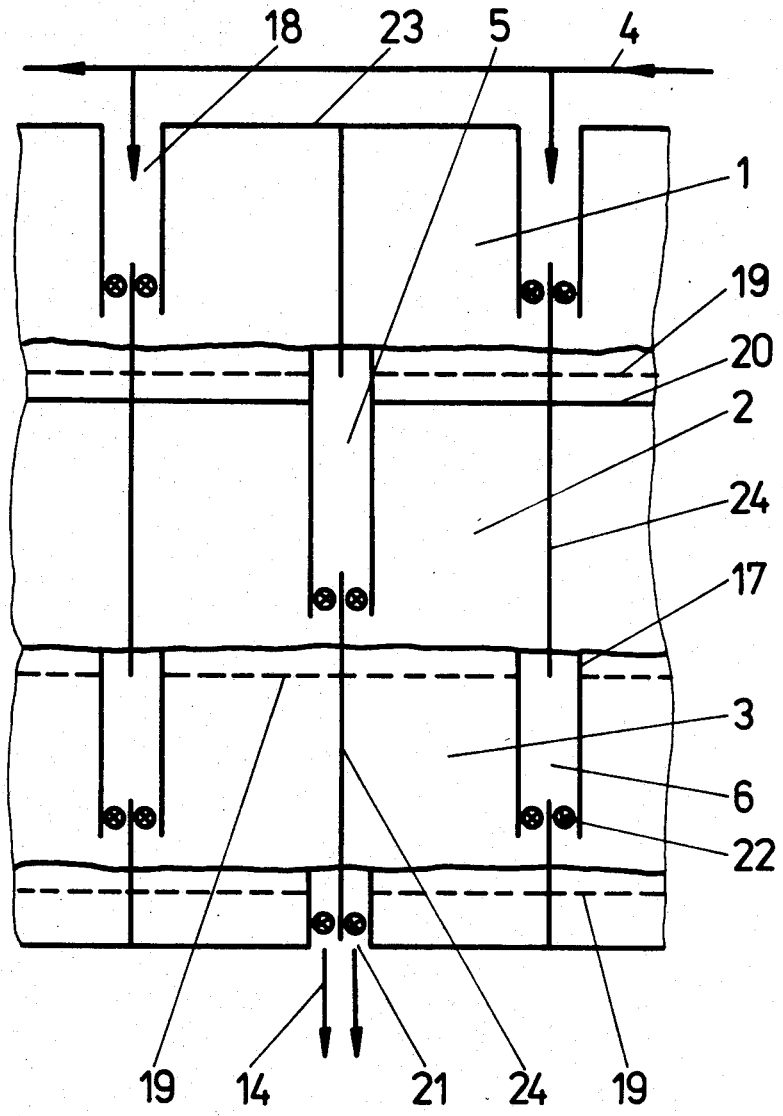
FIG. 2: a partial representation of the apparatus according to the principle.

The offgas 10 of the carbonization chambers 7, 11 is directly supplied to the drying stage 1 as a fluidizing medium which, additionally, is also alternatively heated indirectly by a part of the carbonization gas 13 or the gasification gas 8, and/or is charged with a part of the vapors 15 from the drying. Furthermore, by means of a suitable filter, the dust 16 is removed from the vapors 15 and transferred to a separate low temperature dust carbonization. In the apparatus according to FIG. 2, the solid material transport of each refining stage is indicated respectively occurring from the feeder side to the opposite side, whereby the residence time of the bulk goods in the refining stages is derived from the given width of the reactor in relationship to the height of the discharge dike 17.

The drying stage 1 has a bulk goods charge 18 and the influx floor 19, over which the fluidized bed is formed. Between the drying stage 1 and the degasification stage 2 there is provided a floor 20 which is impermeable to gas, and the two stages are connected to each other by the combined discharge/charge chute 5. In the degasification stage 2 and the refining stage 3, there are also provided influx floors 19, whereby these stages are separated from each other by an influx floor 19, and connected to each other by the discharge/charge chute 6. The ash discharge 21 is provided for the removal of the ash 14. In the bulk goods charge 18, the ash discharge 21 and the discharge/charge chutes 5, 6, there are located the sealing parts 22 for the charge of the solid materials and for the gas-tight separation of the refining stages.

Figure 3:
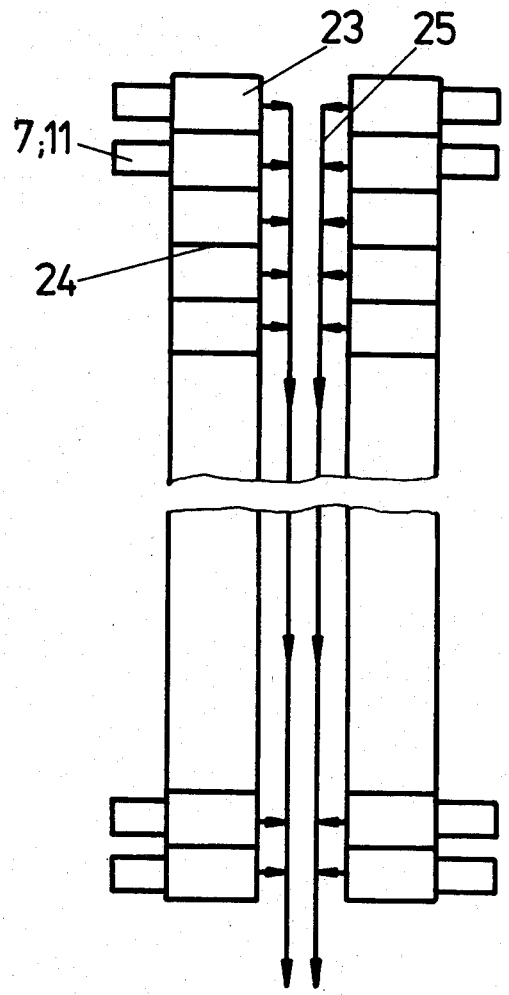
FIG. 3: a configuration of a battery of a large-scale plant seen from the top.

The cells comprising the reactor 23 and the carbonization chambers 7, 11 with integrated preheaters are aligned to a battery according to FIG. 3. Each two adjacent cells have a common separation wall 24, whereby the discharge/charge chutes 5, 6 are positioned on both sides of this separation wall 24, which is discontinuous in this area. Each two cells, therefore, are provided between the same refining stages with a common discharge/charge chute 5, 6. The cells of a battery are connected in parallel with respect to the bulk goods charge 18 and the product discharges 25, 26. The battery configuration in FIG. 3 comprises two rows of 15 cells each, whereby one cell of each row performs the low temperature carbonization of the dust 16 removed from the drying stage 1 of the remaining cells.

The dimensions of the reactor 23 can be, for instance, 1.5 m in width, and 0.7 m in depth. The battery power at 30 cells is approximately 1800 t/d.

For the formation of stabilization zones over the fluidized beds, the reactors 23 in the individual refining stages can be provided with increasing expansions in vertical direction to the longitudinal axis of the battery.

The space between the battery rows is utilized for the supply and discharge of gas, as well as for dust removal apparatus and other devices, such as, for instance, blowers.

In comparison to the known solutions, the invention has the following advantages:

The execution of the process guarantees an improved determination of the residence time and a favorable solid material transport, so that in combination with the number and kind of refining stages, which can be selected from a large range, there is achieved a high variability with respect to the quantity portions and the quality of the end product. Because of the large number of possibilities of providing the energy requirements in the refining stages, on the one hand, materials of various BTU ratings can be utilized for refining, and on the other hand, a high degree of energy effectiveness is assured. The work cycle of the method permits a large-scale utilization.

Because of the building block solution of the reactor, the apparatus is highly compact, which allows a large-scale battery configuration. The construction of the apparatus further increases the variability of the execution of the method, improves the maintenance requirements of the equipment, and ensures the least loss in the utilization of the energy which is recovered in the process, as well as, if necessary, supplied from the outside. The battery configuration lowers the energy losses through radiation, and lowers insulation costs; it requires only a relatively low amount of material costs and space requirements, and thereby represents a low capital investment.

In summary, the present invention is characterized by the provision of a method for multi-stage refining of organic bulk materials according to the fluidized bed principle for the production of low temperature carbonization gas, liquid products and, if necessary, coke, whereby the bulk materials are submitted to a one or multi-stage drying, as well as a one or multi-stage degasification. The dust transported by the fluidizing medium from the drying stage is removed, and the low temperature carbonization gases are recovered in the degasification stages and are transferred to a condensation. The energy requirement of the individual refining stages is provided by recycling a part of the overhead stream in the recycling direction, by introducing of overhead streams in refining stages located upstream for simultaneous fluidization, or by supply from the outside in the form of direct and/or indirect heat transmission. A salient feature of the method is that the solid material transport in each refining stage each time takes place from the feeder side to the opposite side, and the solid material transport, performed by gravity, from a refining stage to the immediately continuous one is performed by a combined discharge/charge chute (5, 6). By omitting the production of coke, the degasification process is immediately continuous to a further refining stage (3), which can be configured either as a carbonization stage or as a gasification stage. The necessary energy requirement of all refining stages can be selectively recovered either from the individual refining stages, or can be supplied from the outside, or by a combination of these two possibilities, whereby the heat transmission occurs directly and/or indirectly.

In a preferred embodiment, the gasification stage is indirectly heated by the offgas (10) of a carbonization chamber (7), the carbonization chamber (7) simultaneously serves for preheating a mixture of a part of the gasification gas (8) and/or water vapor (9), whereby this mixture is supplied directly to the gasification stage, and the offgas (10) of the carbonization chamber (7), if necessary, after a subsequent heating also serves in a second carbonization chamber (11), in addition to the indirect heating of one or more degasification stages (2), through which the gasification gas (8) passes directly. Preferably, the carbonization stage is charged with air (12), and the carbonization gas (13) passes directly through the degasification stages (2), which are indirectly heated by the offgas of a carbonization chamber (11).

Typically, the offgas (10) of the carbonization chambers (7, 11) is transferred to the drying stage or stages (1) as a fluidizing medium, which, additionally, is alternatively indirectly heated with a part of the gasification gas (8) or the carbonization gas (13), and/or is charged with a part of the vapors (15) from drying. Preferably, the dust (16) of the drying stages (1) is transferred to a separate low temperature dust carbonization.

With regard to the apparatus aspect of the present development, the present apparatus for multi-stage refining of organic bulk materials, is specifically intended for the execution of the method as described supra. The apparatus includes one or several drying stages and one or several degasification stages, as well as, if necessary, a carbonization or gasification stage. The bulk materials are formed into a fluidized bed over the influx floor, whereby the bulk materials are conveyed by feeder and discharge apparatus from one refining stage to the subsequent one, and on which aggregates, such as carbonization chamber and preheater, are directly, pressure-tightly mounted. A salient feature of the apparatus is that the refining stages are configured one below another in a reactor (23) having a rectangular cross section, separated from each other by the individual influx floor (19), or a floor (20) which is impermeable to gas, and connected to each other by individual combined discharge/charge chutes (5, 6) positioned on opposite sides. The individual cells including a reactor (23), carbonization chambers (7, 11) and preheaters are aligned in a battery. Preferably, each two adjacent cells are provided with a common separation wall (24), and the combined discharge/charge chutes (5, 6) corresponding to each other of these cells are located on both sides of this separation wall (24), which is discontinuous in this area. Typically, a preheater assigned to a refining stage is an integrated component of the corresponding carbonization chambers (7, 11).

In a preferred embodiment of the present apparatus configuration, the cells of a battery are connected in parallel with respect to the bulk goods charge (18) and product discharges (25, 26). Preferably, an additional cell for low temperature dust carbonization is assigned to a corresponding number of cells of a battery.

It thus will be seen that there is provided a method and apparatus for multi-stage refining of organic bulk materials which attains the various objects of the invention and is well adapted for the conditions of practical use. As numerous alternatives within the scope of the present invention will occur to those skilled in the art, besides those alternatives, variations, embodiments and equivalents mentioned supra and shown in the drawings, it will be understood that the present invention extends fully to all such alternatives and the like, and is to be limited only by the scope of the appended claims, and functional and structural equivalents thereof.

It is therefore claimed:

1. An apparatus for the multi-stage fluidized-bed processing of organic bulk materials comprising a plurality of horizontally aligned cells, each cell comprising a reactor, each reactor having a rectangular horizontal cross-section and comprising an upper drying chamber, a middle degasification chamber and a lower refining chamber vertically arranged in that order, the drying chamber having a top gas impermeable wall and being separated from the next lower degasification chamber by a first gas permeable floor and a first gas impermeable floor vertically spaced below the first gas permeable floor, the degasification chamber being separated from the next lower refining chamber by a second gas permeable floor and the refining chamber having a bottom gas impermeable floor and a third gas permeable floor vertically spaced above the bottom gas impermeable floor, a first vertical transport chute having an upper end and a lower end in the drying chamber for supplying organic bulk materials there to, a second vertical transport chute having one end in said drying chamber and an other end in said degasification chamber, a third vertical transport chute having a first end in said degasification chamber and a second end in said refining chamber, the lower end of the first chute being located above the first gas permeable floor, the one end of the second chute being located above the first gas permeable floor and the other end of the second chute being located above the second gas permeable floor, the first end of the third chute being located above the second gas permeable floor and the second end of the third chute being located above the third gas permeable floor, a first vertical separation wall in the drying chamber extending downwardly from the top gas impermeable wall and centrally into the second vertical transport chute, a second vertical separation wall in the degasification chamber having an upper end extending centrally into the lower end of the first vertical transport chute and at a lower end extending centrally into the first end of the third vertical transport chute, a third vertical separation wall in the refining chamber having an upper end extending centrally into the other end of the second vertical transport chute, an exit chute exiting the apparatus at the bottom of the refining chamber, the third vertical separation wall having a lower end extending centrally into the exit chute, a lowermost vertical separation wall extending upwardly from the bottom gas impermeable floor centrally into the second end of the third vertical transport chute, and means for supplying fluidizing gases to each cell to fluidize said materials above the first, second and third gas permeable floors and gas outlet means for removing said fluidizing gases from each cell, wherein at least one cell of said plurality of horizontally aligned cells is connected to a first adjacent cell by the combination of the first vertical transport chute, the second vertical separation wall, the third vertical transport chute and the lowermost vertical separation wall, and said at least one cell is connected to a second adjacent cell by the combination of the first vertical separation wall, the second vertical transport chute, the third vertical separation wall and the exit chute.

* * * * *